US009700902B2

(12) United States Patent
Albisetti

(10) Patent No.: US 9,700,902 B2
(45) Date of Patent: Jul. 11, 2017

(54) DISPENSING HEAD

(71) Applicant: L'OREAL, Paris (FR)

(72) Inventor: Nicolas Albisetti, Saint Gratien (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/370,424

(22) PCT Filed: Jan. 3, 2013

(86) PCT No.: PCT/IB2013/050059
§ 371 (c)(1),
(2) Date: Jul. 2, 2014

(87) PCT Pub. No.: WO2013/102866
PCT Pub. Date: Jul. 11, 2013

(65) Prior Publication Data

US 2015/0041559 A1 Feb. 12, 2015

Related U.S. Application Data

(60) Provisional application No. 61/604,876, filed on Feb. 29, 2012.

(30) Foreign Application Priority Data

Jan. 3, 2012 (FR) ..... 12 50046

(51) Int. Cl.
*B05B 1/06* (2006.01)
*B65D 83/28* (2006.01)
(Continued)

(52) U.S. Cl.
CPC ..... *B05B 1/06* (2013.01); *B05B 1/26* (2013.01); *B65D 83/205* (2013.01); *B65D 83/28* (2013.01); *B65D 83/30* (2013.01); *B05B 7/0425* (2013.01)

(58) Field of Classification Search
CPC .. B05B 1/06; B05B 1/26; B05B 1/265; B05B 7/0425; B65D 83/28; B65D 83/205; B65D 83/30
(Continued)

(56) References Cited

U.S. PATENT DOCUMENTS 2,681,254 A 6/1954 Fuller
2,785,926 A 3/1957 Lataste
(Continued)

FOREIGN PATENT DOCUMENTS

CH 596 888 A5 3/1978
CN 2 873 317 Y 2/2007
(Continued)

OTHER PUBLICATIONS

International Search Report and the Written Opinion of the International Searching Authority, International Application No. PCT/IB2013/050059.
(Continued)

*Primary Examiner* — Arthur O Hall
*Assistant Examiner* — Juan C Barrera
(74) *Attorney, Agent, or Firm* — Jones Robb, PLLC

(57) ABSTRACT

Dispensing head (1) intended to be fitted on a container that contains at least one product to be dispensed, this dispensing head comprising:

Figure 1:
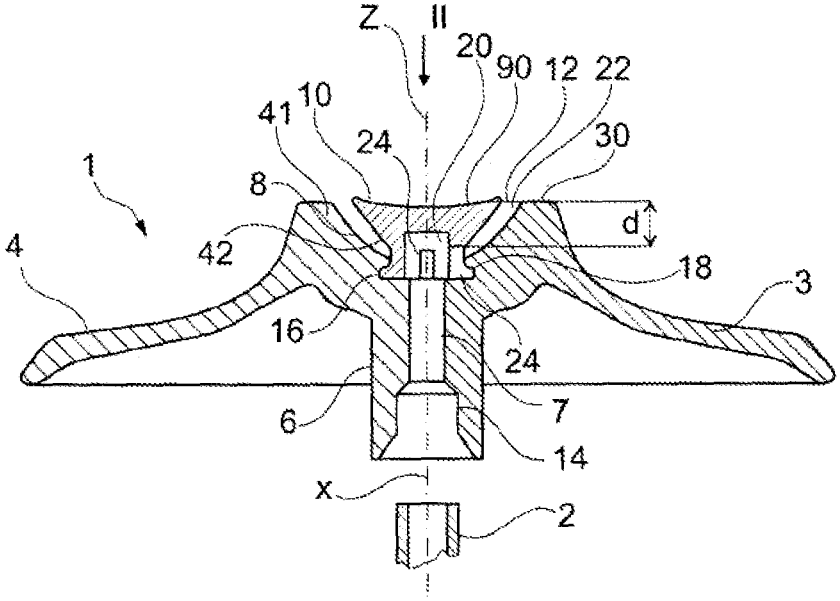

a body (3), an engaging part (10), in particular a core (10), that defines with the body (3), at rest, a dispensing orifice (12) having an annular section.

22 Claims, 7 Drawing Sheets

(51) Int. Cl.

| | |
|---|---|
| ***B05B 1/26*** | (2006.01) |
| ***B65D 83/20*** | (2006.01) |
| ***B65D 83/30*** | (2006.01) |
| *B05B 7/04* | (2006.01) |

(58) Field of Classification Search
USPC ..... 239/146, 337, 428.5, 433, 434.5, 423, 239/523, 590, 310, 314, 315; 34/241
See application file for complete search history.

(56) References Cited

U.S. PATENT DOCUMENTS

| | | | | |
|---|---|---|---|---|
| 2,913,749 | A * | 11/1959 | Ayres | 401/196 |
| 3,462,085 | A | 8/1969 | Nugarus | |
| 4,592,509 | A | 6/1986 | Moss | |
| 5,215,260 | A | 6/1993 | Robbins | |
| 5,297,739 | A | 3/1994 | Allen | |
| 5,617,978 | A * | 4/1997 | Geier | 222/402.13 |
| 5,730,332 | A | 3/1998 | Zimmerhackel | |
| 6,257,503 | B1 | 7/2001 | Baudin | |
| 6,338,442 | B1 * | 1/2002 | De Laforcade | B65D 83/207 222/402.21 |
| 7,500,621 | B2 * | 3/2009 | Tryon | B05B 1/1654 222/402.1 |
| 7,950,597 | B2 * | 5/2011 | Vanblaere et al. | 239/337 |
| 2003/0158527 | A1 | 8/2003 | Mezzoli | |
| 2005/0224524 | A1 * | 10/2005 | Khan | B05B 1/14 222/402.13 |
| 2009/0060710 | A1 * | 3/2009 | Gammack | F04D 25/06 415/90 |
| 2012/0234947 | A1 | 9/2012 | Takahashi | |
| 2015/0014443 | A1 | 1/2015 | Albisetti | |

FOREIGN PATENT DOCUMENTS

| | | | |
|---|---|---|---|
| CN | 201 558 753 | U | 8/2010 |
| DE | 296 22 069 | U1 | 3/1997 |
| EP | 1 035 038 | A1 | 9/2000 |
| EP | 1 052 023 | A1 | 11/2000 |
| GB | 1 009 170 | A | 11/1965 |
| WO | 02/07894 | A1 | 1/2002 |
| WO | 2011/065413 | A1 | 6/2011 |
| WO | 2013102865 | A1 | 7/2013 |
| WO | 2013102866 | A1 | 7/2013 |

OTHER PUBLICATIONS

International Search Report and the Written Opinion of the International Searching Authority for related International Application No. PCT/IB2013/050056, dated Mar. 25, 2013.
Preliminary Search Report and Written Opinion for related International Application No. PCT/IB2013/050056, dated dated Jul. 8, 2014.
French Preliminary Search Report for related French Application No. FR 12 50039 ,dated Jun. 18, 2014, with machine-generated English translation.
Non-Final Office Action for U.S. Appl. No. 14/370,426 dated Jun. 16, 2016.

* cited by examiner

DISPENSING HEAD

This is a national stage application of PCT/IB2013/050059, filed internationally on Jan. 3, 2013, which claims priority to French Application No. FR 1250046, filed Jan. 3, 2012, and U.S. Provisional Application No. 61/604,876, filed Feb. 29, 2012, the entire disclosures of each of which are incorporated herein by reference.

The present invention relates to dispensing heads used for dispensing a product contained in a container, in particular for spraying it.

The invention relates more particularly, but not exclusively, to spray heads intended to be fitted on pressurized containers that contain cosmetic products.

Numerous spray heads have been proposed, having one or more dispensing orifice(s). Numerous parameters should be taken into consideration when designing a spray head.

First of all, the spray generated should have the granulometry suitable for the application. In this respect, the size of the droplets should not be too small or too large.

Furthermore, the spray generated should be delivered at the flow rate required and the spray head should not subject the flow of product to an excessive pressure drop.

The form of the spray should likewise correspond to the intended application and thus make it possible, as the case may be, to cover a more or less extensive area.

Finally, the spray head should be aesthetically pleasing to the consumer, and its manufacture should be compatible with the requirements of large-scale production.

The invention aims to propose a novel dispensing head which is very particularly suitable for spraying a cosmetic product.

Application EP 1 052 023 A1 discloses a spray head comprising a dispensing orifice defined between a closure member having a frustoconical part and the body of the head. The closure member is opened by deformation of the frustoconical part, under the pressure of the product during dispensing. A conical and hollow spray is formed at least in the vicinity of the head. The deformation of the frustoconical part makes it possible to close the dispensing head after each spraying and to reduce the risk of clogging of the dispensing orifice by drying of the product. The deformability of the frustoconical part does not make it possible to have, during dispensing, a dispensing orifice having well-calibrated dimensions, and the characteristics of the spray emitted are likely to vary widely.

Application EP 1 035 038 A1 discloses a body on a container comprising a valve that opens by pressure on the body.

Applications WO 2011/065413 and CH 596 888 disclose various arrangements of spray heads in which a spray orifice is defined between a peripheral part and a central part which are connected together by bridges of material. The presence of these bridges of material splits the flow of product into a number of jets, and this can impair good homogeneity of the spray.

The subject of the invention, according to a first of its aspects, is a dispensing head intended to be fitted on a container that contains at least one product to be dispensed, this dispensing head comprising:

- a body,
- an engaging part that defines with the body, at rest, a dispensing orifice, advantageously having an annular section, this dispensing orifice being or not being the only dispensing orifice in the head.

The body may define a housing that receives the engaging part, which is then called a core.

The expression "at rest" should be understood as meaning before the core is exposed to the pressure of the product to be dispensed. Thus, the dispensing orifice is already formed and open when the product is sent into the head in order to be dispensed.

By virtue of the invention, in the case of spraying, the spray can be emitted at a relatively high flow rate, if desired, while having a spray head which has a relatively simple design and functions reliably. In particular, the dispensing orifice may be produced with well-defined dimensions. In addition, the dispensing head may be aesthetically pleasing to the consumer.

The housing may have a first surface that flares towards the outside, or converges towards the outside, and the engaging part may have a second surface, opposite the first surface, that diverges towards the outside, or converges towards the outside. The first surface may be conical. The second surface may be conical, with the same angle as the first surface or with a greater or smaller angle.

A different angle, which results in a widening of the space formed between the engaging part and the body on moving towards the dispensing orifice, may prove to be preferable in the case of the dispensing of a foam, in order to allow the latter to expand and to slow down before it leaves through the dispensing orifice.

A different angle that results in a narrowing of the space may lead to an acceleration of the jet before it exits, and this may be advantageous in the context of a spray.

It is possible for the body not to be ogive-shaped in the dispensing region. The external surface of the body may have a concave shape towards the outside.

The dispensing orifice may have a constant width in the circumferential direction. The dispensing orifice may be defined between two concentric surfaces of revolution, for example in the form of cylinders of revolution.

The dispensing orifice may have axial symmetry, preferably rotational symmetry, in particular around the dispensing axis. The dispensing axis is defined by the general direction in which the product is dispensed by the head.

It is possible for the dispensing axis not to be coaxial with the outlet axis of the container.

The engaging part is preferably attached, thereby making it, and the body, easier to manufacture.

Alternatively, the engaging part is moulded as one part with the body, in particular in the case of the dispensing of a foam, the dispensing orifice then having a larger section than in the case of the spraying of a spray.

The engaging part, in particular the core, may be hollow and/or provided with an internal recess that communicates with a space formed between said part and the body, the product reaching the dispensing orifice through said space. This communication may take place for example through at least one passage, in particular through one or more slots, which are preferably open towards the bottom of the housing and towards said space in order to make it easier to mould the engaging part.

The face of the engaging part that is directed towards the outside may be hollow, in particular form a small cavity, or be planar.

The body may comprise a supply duct that opens out next to the internal recess in the engaging part, in particular the core, the product to be sprayed reaching the engaging part through this supply duct.

The section of the supply duct which feeds the space formed between the body and the engaging part is preferably greater than that of the dispensing orifice, thereby making it easier to fill this space before the product emerges through the dispensing orifice.

A product distribution chamber may be formed, between the engaging part and the body, upstream of the dispensing orifice.

A narrowing of the section may be formed by an annular lip between the distribution chamber and the passage leading to the dispensing orifice.

The supply duct for the product may open into this chamber, which preferably has an annular shape. Its width, which corresponds to the gap between the engaging part and the body, is preferably greater than the maximum width of the passage, via which the distribution chamber communicates with the dispensing orifice.

At least one of the body and the engaging part may have at least one relief for centring the engaging part in relation to the body, and preferably at least two, better still at least three, and even better still at least about ten reliefs. This or these reliefs are located set back sufficiently from the dispensing orifice for the spray emerging through the dispensing orifice to be in the form of a single jet. The reliefs can be produced on the body, being for example in the form of axial ribs that are distributed regularly around the entire inner circumference opposite the engaging part.

The centring reliefs may optionally ensure alone that the engaging part is held in the body. Alternatively, the engaging part is fixed in the body somewhere other than in the region of the centring reliefs, it being possible in this case for the centring reliefs to have or not have a function of holding the engaging part in the body.

The engaging part may comprise a foot fixed to the body, the foot extending on the side of the engaging part that is located opposite the dispensing orifice, the product being supplied into the space formed between the engaging part and the body preferably in this case by way of a supply duct that opens into said space at a location between the two opposite axial ends of the engaging part. The axis of the supply duct may be perpendicular to the dispensing axis or alternatively parallel to the spraying direction, at least for the portion which opens onto the engaging part.

A passage may pass through the engaging part, similarly to the body, said passage preferably being coaxial with the dispensing direction, allowing a finger or a lock of hair, for example, to be inserted through the dispensing head. A hollow engaging part may also make it possible to produce a flow of air through the dispensing head under the entrainment effect of the spray emitted. The engaging part may also be solid.

Preferably, the engaging part is fixed in the housing. Alternatively, the engaging part is fixed in an adjustable manner in the housing, in order for example to allow the user to adjust the width of the dispensing orifice or to close the latter when not in use, for example by screwing it through a quarter turn, the screwing being accompanied by an axial movement of the engaging part in relation to the body.

The engaging part may lie flush with the front end of the body so as to generate a spray with an axis substantially parallel to the axis of the engaging part.

The engaging part may extend axially beyond the front end of the body by an amount lying between 0 and 1 mm, and better still between 0 and 0.5 mm. The spray may then diverge away from axis of the engaging part.

The engaging part may be axially set back from the front end of the body by an amount lying between 0 and 1 mm, and still better between 0 and 0.5 mm. The spray may then converge towards the axis of the engaging part.

The invention makes it possible to easily produce, if desired, a dispensing orifice having a circular inner contour, the inside diameter being for example greater than or equal to 10 mm, better still 15 mm, 20 mm or 30 mm.

The head may comprise at least two housings and two engaging parts that are disposed in the housings and each define with the body, at rest, a dispensing orifice according to the invention. The dispensing axes may then be parallel or not parallel, intersecting or not intersecting, for example converging towards one another.

A further subject of the invention, according to another of its aspects, is a container provided with a dispensing head according to the invention.

The product may be a cosmetic product, preferably for external use, to be dispensed in the form of a spray or a foam, in particular onto a human keratinous surface.

The product is dispensed at a temperature less than or equal to ambient temperature, in particular less than or equal to 40° C., better still less than or equal to 37° C.

The container may be a pressurized container, provided for example with a hollow valve rod inserted into a nozzle in the head that is suitable for holding said rod.

The dispensing head may be used without coming into contact with the part to which the product is intended to be applied and need not be adapted to come into contact therewith.

A further subject of the invention is a cosmetic treatment method comprising the step of applying a cosmetic product by pressing a dispensing head according to the invention, the dispensing head being fitted on a container.

Figure 4:
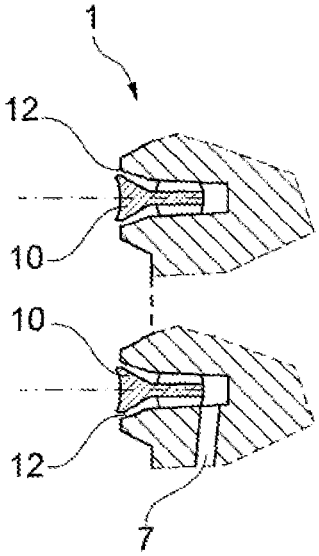
Figure 2:
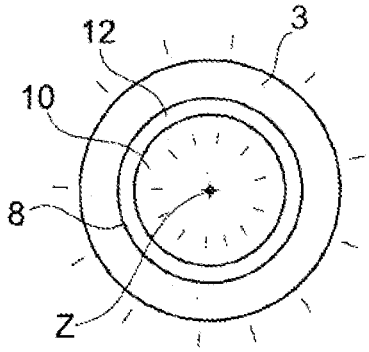
Figure 3:
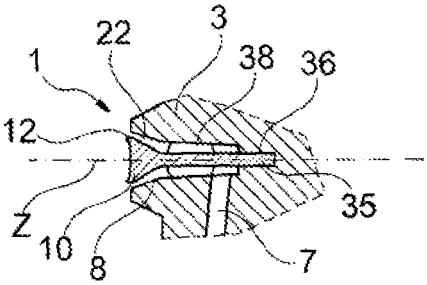
Figure 5A:
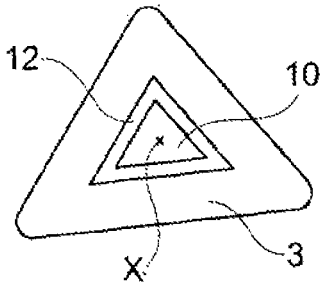
Figure 5B:
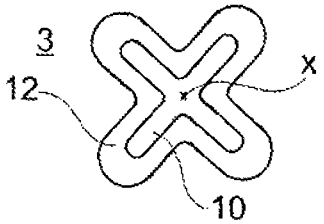
Figure 5C:
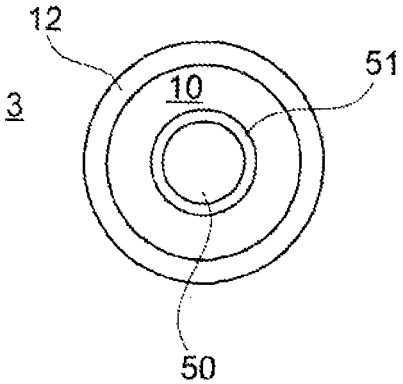
Figure 6A:
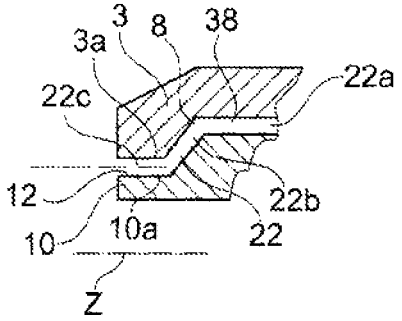
Figure 10:
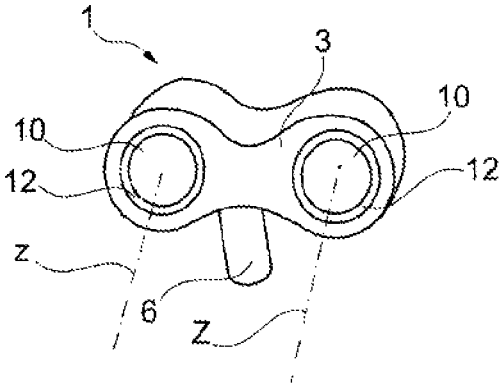
Figure 6B:
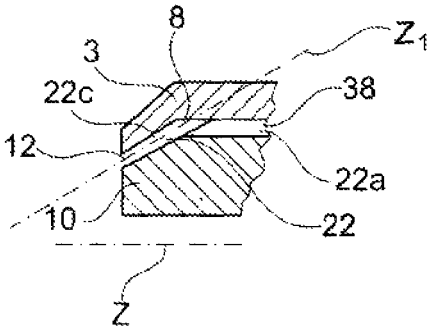
Figure 6E:
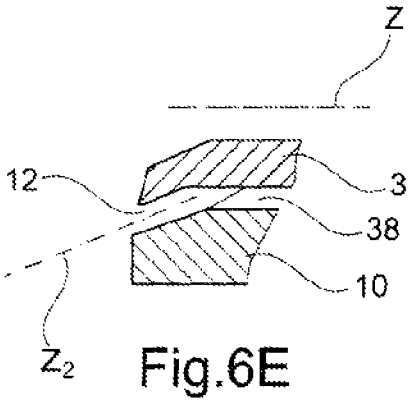
Figure 6C:
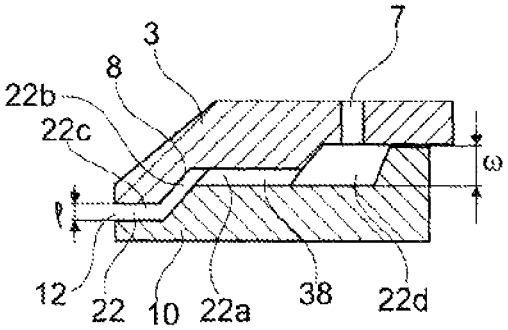
Figure 6D:
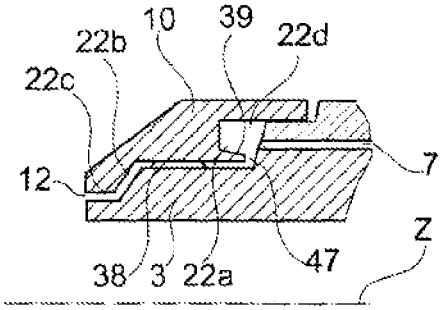
Figure 7:
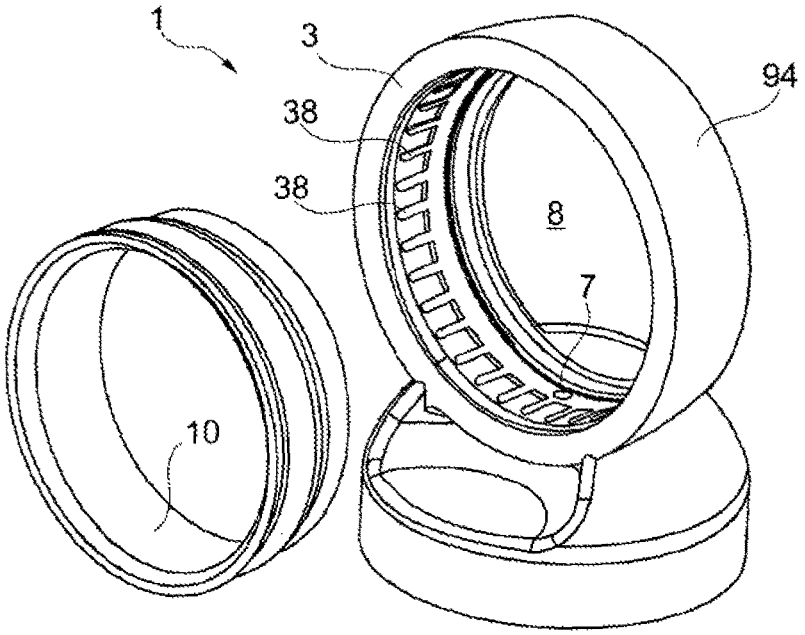
Figure 9:
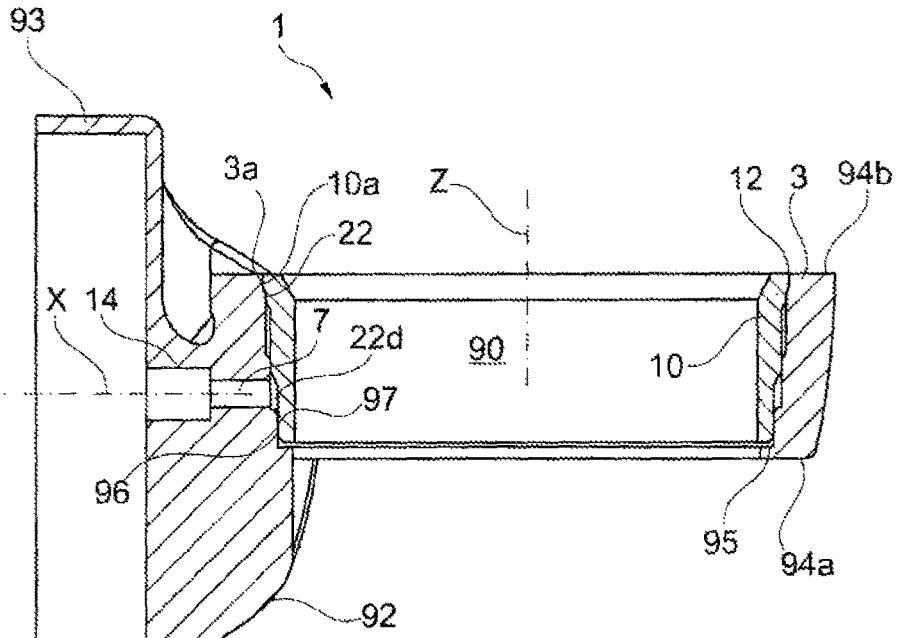
Figure 8:
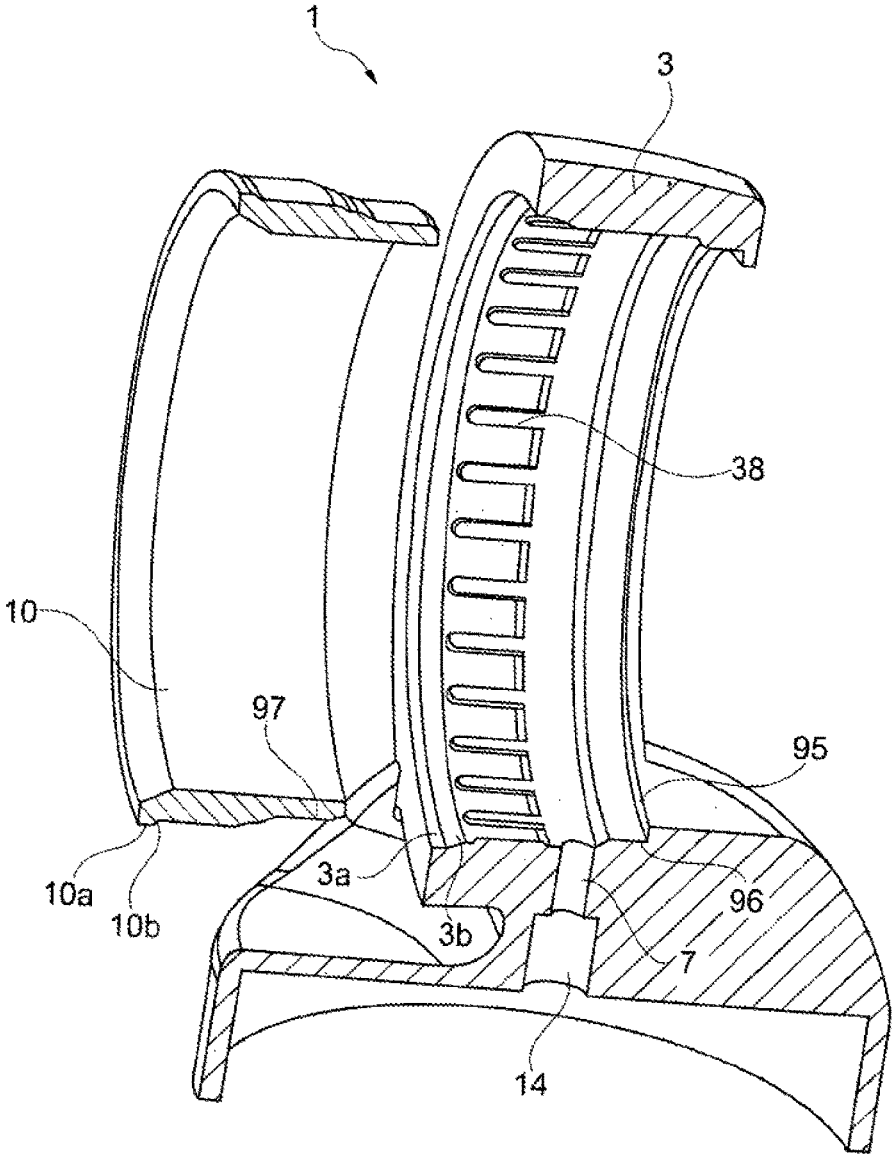
Figure 11:
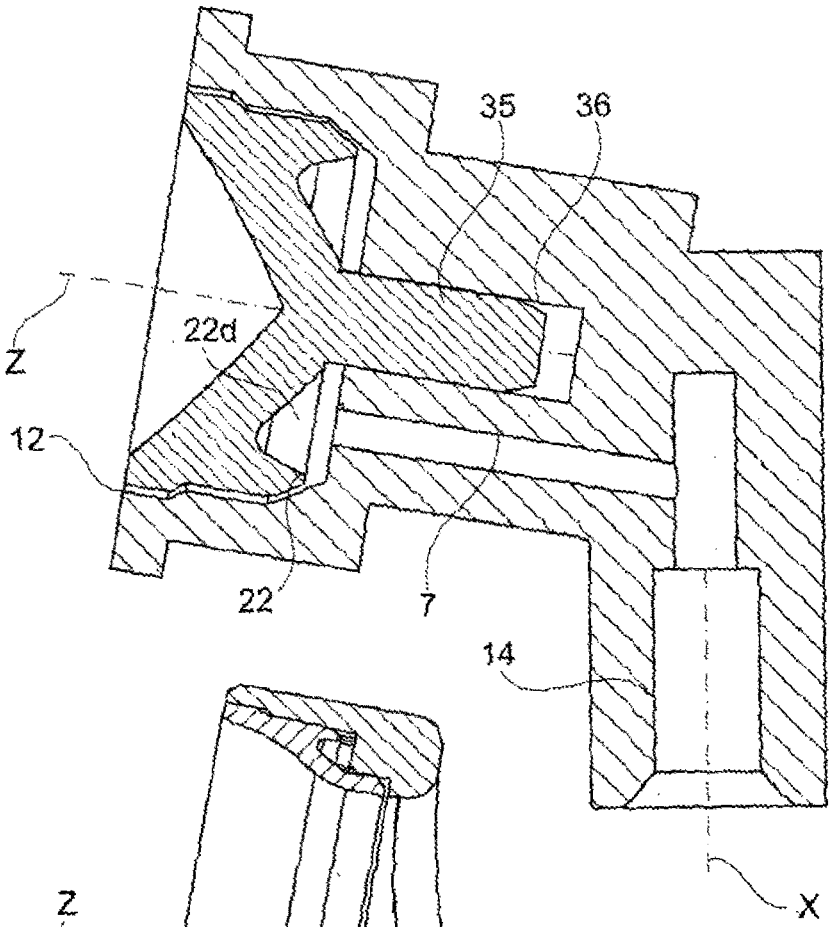
Figure 12:
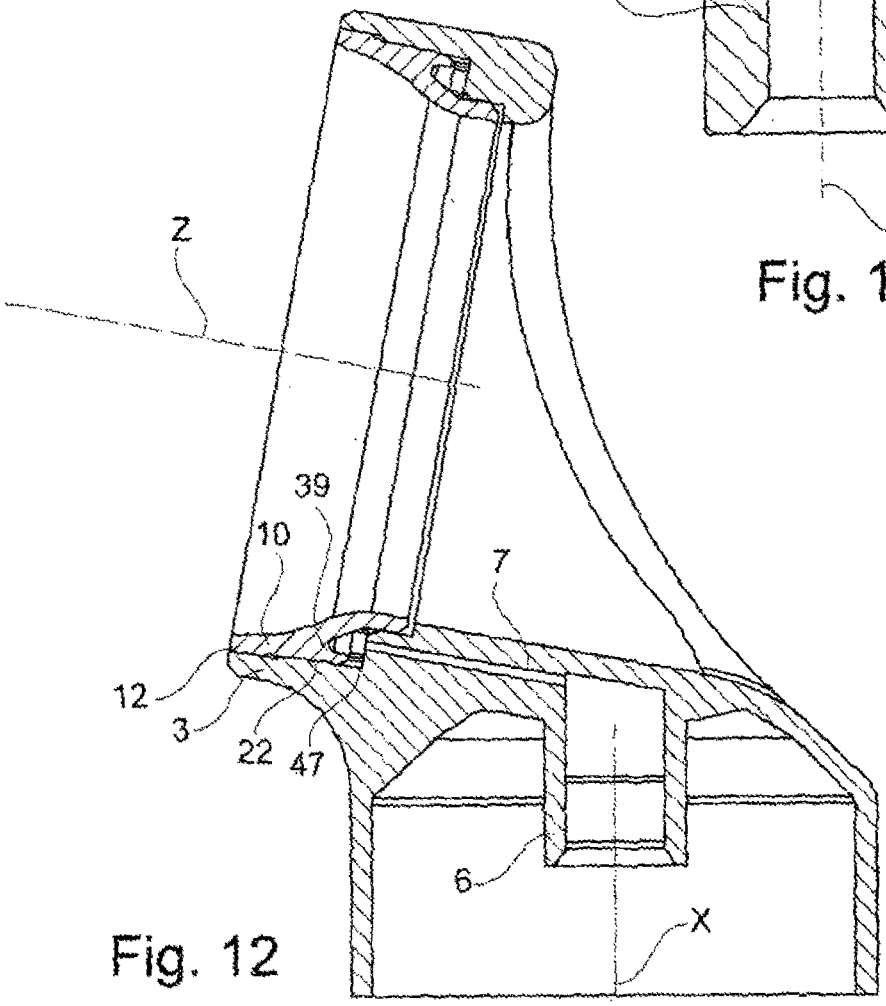
Figure 13A:
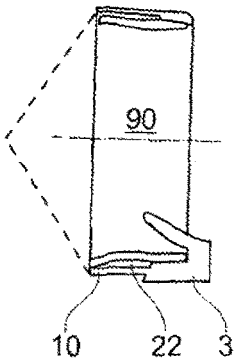
Figure 13B:
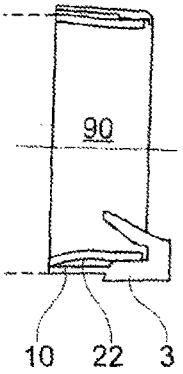
Figure 13C:
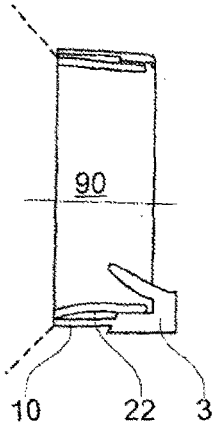
Figure 14A:
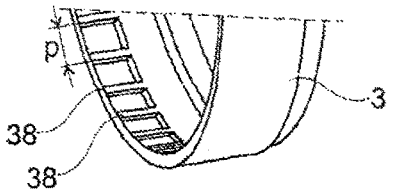
Figure 14B:
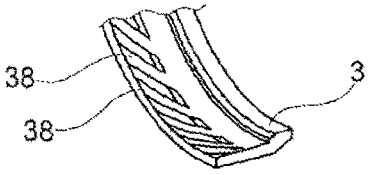
Figure 14C:
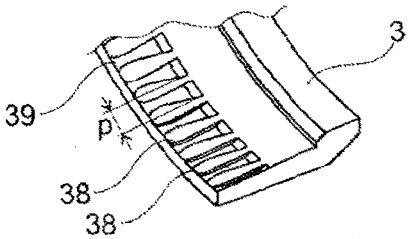

The invention may be better understood from reading the following detailed description of non-limiting implementation examples thereof and from examining the appended drawing, in which:

FIG. 1 is a schematic and partial axial cross section through an example of a dispensing head according to the invention, FIG. 2 is a top view along II in FIG. 1, FIG. 3 is a schematic view of a variant embodiment of a dispensing head according to the invention, FIG. 4 is a view similar to FIG. 3 of one variant embodiment, FIGS. 5A 5B, and 5C are views similar to FIG. 2 of other variant embodiments, FIGS. 6A to 6E show production details of the head according to variants, FIGS. 7 and 8 show schematic perspective views of a variant dispensing head, FIG. 9 shows the head from FIG. 7 in cross section, FIG. 10 shows a schematic perspective view of a variant embodiment having two dispensing orifices, FIG. 11 is a view similar to FIG. 3 of a variant embodiment of the head, FIG. 12 is a view similar to FIG. 9 of another variant, FIGS. 13A to 13C illustrate variant configuration of the engaging part relative to the body, and FIGS. 14A to 14C illustrate variant arrangements of the reliefs on the body.

In the drawing, the actual respective proportions of the various constituent elements have not always been respected, for the sake of clarity.

The dispensing head 1 shown in FIG. 1 is intended to be fitted on a container (not shown) provided with a hollow valve rod 2 or hollow pump rod, through which the product to be dispensed that is contained in the container is conveyed towards the head 1.

The container may in particular be a pressurized container of the aerosol can type, containing a propellant gas such as compressed air, for example, or a liquefied gas. The container may contain at least one cosmetic, dermatological or other compound, in particular intended for domestic application. The product may be intended to be sprayed or to be dispensed in some other way, in the form of a foam, for example. The proportion by weight of gas, especially in liquefied form, within the cosmetic composition may be 50% or more, and in particular lie between 50 and 60%, especially in the case of an alcohol-based cosmetic compound, or even between 70 and 80%, especially in the case of a cosmetic compound in the form of an emulsion, or even between 80 and 95%, especially in the case of an anhydrous cosmetic compound. The cosmetic compound dispensed may be a mixture of water, alcohol, oil and gas.

The head 1 comprises a body 3 which may be produced in an integral manner by moulding a single part or may comprise a plurality of elements produced separately and joined together.

The body 3 may define a pressing surface 4 which the user may press in order to trigger dispensing.

The container may be provided with a valve and the valve may be opened for example by pressing the hollow rod 2 or alternatively by tilting the latter. When the container is provided with a pump, the pump may be actuated for example by pressing the hollow rod 2 along its longitudinal axis X.

The dispensing head 1 comprises a nozzle 6 intended to engage with the hollow rod 2 in order to allow the product delivered through the latter to reach a supply duct 7 which opens into a housing 8 in the body 3. The supply duct 7 is for example coaxial with the rod 2, as illustrated, but could be oriented in some other way and have for example a plurality of differently oriented portions.

An engaging part 10, called core in the following text when it is inside the body 3, is fixed in the housing 8 and defines with the body 3 a dispensing orifice 12 having an annular section, for example having a constant circumferential width l around the axis X, as illustrated in FIG. 2.

The expression "annular section" should be understood within the meaning of the present invention as meaning any section that follows a closed contour, whether this contour is circular, elliptical, polygonal or some other shape. Thus, the triangular and cross-shaped sections illustrated in FIGS. 5A and 5B are considered to be annular within the meaning of the invention. The annular section of the dispensing orifice 12 may, in other variants, be square, pentagonal, hexagonal, oblong, kidney-shaped or eight-shaped.

Preferably, the circumferential width l around the spraying direction Z, is constant. If this width l varies, for example so as to take into account the possibly non-uniform pressure drop experienced by the flow of product upstream of the dispensing orifice 12, this does not depart from the scope of the present invention. This non-uniform pressure drop results for example from the geometry of the space between the core and the body, in particular the presence of angles or intersections. By varying the width l, it is possible to ensure that the product can emerge more easily at the point where this pressure drop is greatest, when the aim is to have a spray which is as homogeneous as possible.

The width l of the dispensing orifice is for example between 0.01 and 0.15 mm for spraying a spray and 0.5 to 2 mm for dispensing a foam.

The nozzle 6 comprises a housing 14 having a dimension adapted to the outside diameter of the rod 2, so as to obtain a sealed fit of the hollow rod 2 in the housing 14, in order that the product delivered through the rod 2 passes entirely into the supply duct 7.

The core 10 can be fixed to the body 3 in various ways. In the example illustrated in FIG. 1, the core 10 is snap-fastened onto the body 3 by virtue for example of a bead 16 formed at the base of the core 10 and snap-fastened into an annular groove 18 formed at the base of the housing 8.

The core 10 has a blind internal recess 20 which is open in the direction of the supply duct 7.

Preferably, as illustrated, the inside diameter of the internal recess 20, which is for example in the form of a cylinder of revolution about the axis Z, is greater than or equal to the diameter of the supply duct 7.

The internal recess 20 communicates with the space 22 formed between the core 10 and the housing 8, for example via one or more radial slots 24, of which there are four in the example illustrated. These slots 24 are for example less high than the recess 20.

In the example illustrated, the core 10 is produced separately from the body 3 and attached to the latter. The core 10 can be produced from the same thermoplastic material as the body 3 or alternatively from a different thermoplastic material. It is also possible to use a metal material to produce the core 10.

The axial dimension d of the space 22, having an annular shape, between the dispensing orifice 12 and the upper end of the slots 24 is, for example, between 2 and 15 mm.

A dimension d greater than or equal to 4 mm may in particular help to homogenize the flow of the product before it leaves the head through the dispensing orifice.

The housing 8 has a first surface 41, for example diverging towards the outside, which is for example conical, and the core 10 has a second surface 42, which is for example likewise conical, for example also diverging towards the outside. The cone angles of the surfaces 41 and 42 may be identical. Alternatively, these angles are different. The cone angle of the surfaces 41 and 42 is for example between 2° and 10°.

The width of the space 22 may decrease towards the dispensing orifice 12 in order to increase the speed of the outlet flow.

FIGS. 6A to 6E illustrate different examples of possible configurations for the space 22 formed between the core 10 and the body 3 for the flow of the product.

In the example in FIG. 6A, the space 22 formed between the core and the body comprises a proximal portion 22*a* in which centring reliefs 38 of the core 10 extend in relation to the body 3, extended by an intermediate portion 22*b* which forms an angle with the spraying direction Z, for example a re-entrant angle. This intermediate portion 22*b* can be attached to a terminal portion 22*c*, which opens onto the dispensing orifice 12, this terminal portion being defined for example, as illustrated, between two surfaces 3*a* and 10*a*, in the form of cylinders of revolution, parallel to the dispensing direction Z.

In the variant in FIG. 6B, the terminal portion 22*c* communicates with that portion 22*a* in which the centring reliefs 38 extend. The terminal portion 22*c* forms, for example, an angle with the dispensing direction Z. Thus, in axial half section, the axis $Z_1$ of the orifice 12 is for example convergent, as illustrated.

In the variant in FIG. 6C, a distribution chamber 22*d* is formed upstream of the space 22*a* in which the centring reliefs 38 extend. This distribution chamber 22*d* receives the product delivered by the supply duct 7, which communicates with the container that contains the product.

The width ω of the distribution chamber 22*d* is greater than that of the space 22*c* in which the centring reliefs 38 extend and also greater than that of any intermediate position, which is present in the example in FIG. 6C, and greater than that l of the terminal portion 22*c* which opens onto the dispensing orifice 12.

The distribution chamber 22*d* improves the distribution of the product before the latter reaches the narrowest portions of the passage through which the product is evacuated.

In the variant in FIG. 6D, the engaging part 10 is outside the body 3. The engaging part 10 is fixed to the body 3 so as to form with the latter the distribution chamber 22*d*, facing the supply duct 7. The portions 22*a*, 22*b* and 22*c* allow the product to be conveyed to the dispensing orifice 12.

The supply duct 7 opens for example into the distribution chamber 22*d* via a portion oriented parallel to the dispensing axis Z.

Centring reliefs 38 are produced for example on the body 3. The engaging part 10 can be produced, as illustrated, with an annular lip 39 which partially delimits the distribution chamber 22*d* and forms a narrowing 47 of the section between the chamber 22*d* and the portion 22*a*. The centring reliefs 38 may, as illustrated in FIGS. 14A to 14C, be parallel or oblique in the circumferential direction to the axis Z, or curved. Each relief 38 may have, when observed from above, a polygonal, especially rectangular or trapezoidal, outline, or be flared in the direction of the dispensing edge. Two centring reliefs 38 may define, between each other, a narrowing 39 near the dispensing orifice so as to accelerate the fluid via the Venturi effect. The number of centring reliefs 38 is preferably at least 10, better 20, and even better 40.

FIG. 6E illustrates the possibility of having an angle which is divergent between the axis $Z_2$, in axial half section, of the orifice 12 and the dispensing axis.

The front face 70 of the core 10 may have any shape and be, for example, concave towards the outside.

FIG. 3 illustrates the possibility of fixing the core 10 to the body 3 of the dispensing head in some other way. In this example, the core 10 has a foot 35 which is anchored in a corresponding depression 36 provided in the bottom of the housing 8. One or more reliefs 38 centre the core in the housing 8, being produced for example in one piece with the core 10. Alternatively, the centring relief or reliefs are produced in one piece with the housing 8 by moulding. In all cases, the reliefs 38 are advantageously located set back from the dispensing orifice, so as to allow the emission of a single jet through the dispensing orifice 12.

The product enters the housing 8 preferably upstream of the reliefs 38, as illustrated. The supply duct 7 may in particular be oriented perpendicularly to the dispensing direction. Alternatively, the supply duct 7 is oriented parallel to the dispensing direction Z, at least in its portion which opens out next to the engaging part 10.

The core 10 may, as illustrated in FIG. 13A, be set back relative to the body by an amount lying between 0 and 1 mm, better still between 0 and 0.5 mm. The body 3 protrudes into the dispensing orifice and may generate a convergent spray.

The core 10 may, as illustrated in FIG. 13B, lie flush with the body 3. The spray may then be straight.

The core 10 may extend, as illustrated in FIG. 13C, forwards, relative to the body 3, by an amount lying between 0 and 1 mm, better still between 0 and 0.5 mm. The spray may then diverge.

A variant embodiment of the dispensing head 1 will now be described with reference to FIGS. 7 to 9.

This variant has the particular feature of having a core 10 formed by a perforated insert attached to the body 3 of the head 1. Thus, an opening 90 passes axially through the core 10, it being possible for the inside diameter of said opening 90, when the core is in the form of a tube having an approximately circular section, to be relatively large, for example greater than or equal to 10 mm, better still 15, 20 or 30 mm.

The opening 90 helps to give the head a particularly aesthetic appearance. In addition, the opening 90 can allow air to flow through the head under the entrainment effect of a spray emitted through the dispensing orifice 12. This can help to increase the range of the spray and can increase the freshness effect provided thereby, if need be.

The opening 90 may also allow a finger or a lock of hair to be inserted through the head, and this can make it possible to apply a product in a single movement over the entire circumference of the element inserted through the head. This can be an advantage for applying for example an antiseptic or care product to a finger or for treating a lock of hair.

The axis Z may be perpendicular to the longitudinal axis X of the container on which the head is fitted, as illustrated in FIGS. 7 to 9.

The head 1 may comprise a base 92 which defines a surface which the user can press in order to bring about dispensing.

The bottom of the base 92 can be extended by an enclosing skirt 93 which covers the upper part of the container.

The housing 8 which receives the core 10 is defined by a crown 94 of axis Z, the lower side of which is joined to the base 92. The supply duct 7 passes through the base 92 and leads into the housing 8 at a distance from the axial ends, along the axis Z, of the crown 94, being preferably closer to the rear end 94*a* than to the front end 94*b*, as can be seen in FIG. 9.

The body 3 may have, as illustrated, a shoulder 95 close to the rear end 94*a*, against which the core 10 can come into axial abutment, if need be, at the end of its fitting.

The core 10 and the housing 8 may have annular surfaces 96 and 97, in sealed contact, in order to close the space formed between the core 10 and the body 3 at the rear of the supply duct 7.

In the example illustrated in FIGS. 7 to 9, the space formed between the core 10 and the body 3 comprises a distribution chamber 22*d*, into which the supply duct 7 opens.

Centring reliefs 38 are formed on the internal circumference of the housing 8, as can be seen in particular in FIG. 7, in order to centre the core 10 in the housing 8.

The space 32 formed between the core 10 and the body 3 may have the configuration illustrated in FIG. 6C, and open onto the dispensing orifice 12 by way of an annular portion formed between two surfaces 3*a* and 10*a* which are in the form of cylinders of revolution about the axis Z.

The space 22 may comprise an inclined intermediate portion 22*b*, formed between opposite faces 3*b* and 10*b*, that diverges towards the dispensing orifice 12.

When the user actuates the dispensing head 1, the product passes through the supply duct 7 into the space 22 between the core 10 and the body 3 and can be delivered in the form of a spray through the dispensing orifice 12.

The spray is continued angularly around the dispensing axis on account of the absence of contact between the core and the body in the region of the dispensing orifice 12. Specifically, the bearing region or regions between the core 10 and the body 3 are preferably located set back from the dispensing orifice 12 by a distance (measured along the dispensing axis) of at least 0.5 mm.

Preferably, the cross section of the supply duct 7 is greater than the section of the dispensing orifice 12 so as to allow the space located upstream of the dispensing orifice to be filled rapidly with the product, this being able to help to form a homogeneous spray right from the start of spraying.

The invention is not limited to a dispensing head comprising only one dispensing orifice 12 produced in accordance with the invention.

By way of example, FIGS. 4 to 10 illustrate a dispensing head 1 which comprises two dispensing orifices 12.

The dispensing orifice 12 may be the only dispensing orifice of the device and be formed between the core and the body. If an additional dispensing orifice is provided, for example formed inside the core, for example by an axial through-hole therein, in particular in line with the recess 20, or by attaching inside the core 10 a second core 50 which defines with the first core 10 a second dispensing orifice 51 which is coaxial with the first dispensing orifice, as illustrated in FIG. 5C, this does not depart from the scope of the present invention.

It is possible for the axis Z not to be perpendicular to the axis of the rod of the container on which the head is fitted, as illustrated in FIG. 12. In this example, the axis Z is oriented upwards when the container is vertical with the dispensing head at the top.

The supply duct 7 can be oriented substantially parallel to the dispensing axis Z, at least in the case of the portion which opens out next to the engaging part 10. The latter may be produced with an annular lip 39 which defines a narrowing of the section 47.

The configuration may be similar to that in FIG. 6D apart from the fact that the engaging part 10 is outside the body 3 in the example in FIG. 6D and inside it in the example in FIG. 12.

When there are a plurality of dispensing orifices, these may be distributed in multiple ways on the dispensing head. For example, the spraying axes are parallel, or form an angle, in that, for example, they intersect.

The dispensing orifice may be supplied with more than one product.

The dispensing head may be supplied with two products which are dispensed through separate dispensing orifices, each produced in accordance with the invention.

The dispensing head may be arranged so as to allow a protective cap to be fitted and to comprise, if need be, an on/off system that makes it possible to prevent the actuation of the device when the dispensing head is in a certain position with respect to the container or when a locking element of the dispensing head is in a certain position in relation to the latter.

The product to be sprayed may be a deodorant, in particular a deodorant that contains an alcohol, an antiperspirant, a hair-care product, a shaving foam, among other possibilities.

In variants, the dispensing orifice is formed between a body and an engaging part, the body being radially on the inside with respect to the engaging part, the supply duct for the product passing through the body, as illustrated in FIG. 6D. All of the features described with reference to the other figures can be found in variants in which the body is radially on the inside with respect to the engaging part.

The expression "comprising a" should be understood as being synonymous with "comprising at least one".

The invention claimed is:

1. A container comprising:

at least one cosmetic product to be dispensed contained in the container;

at least one hollow valve rod or hollow pump rod; and a dispensing head, the dispensing head comprising:

a body; and an engaging part that defines with the body, at rest, a dispensing orifice having an annular section, the dispensing orifice being formed between the engaging part and the body such that the dispensing orifice is already open when the cosmetic product is sent into the dispensing head to be dispensed, wherein the dispensing head is configured to be pressed to activate the hollow valve rod or hollow pump rod to convey the at least one cosmetic product through the dispensing orifice of the dispensing head from the container.

2. The container according to claim 1, wherein the dispensing head further comprises an opening passing axially through the engaging part.

3. The container according to claim 1, wherein the dispensing head further comprises a distribution chamber being formed upstream of the dispensing orifice between the engaging part and the body, wherein a supply duct for the product opens onto said distribution chamber.

4. The container according to claim 1, wherein the width of the space between the engaging part and the body decreases towards the dispensing orifice.

5. The container according to claim 1, wherein the width of the space between the engaging part and the body increases towards the dispensing orifice.

6. The container according to claim 1, wherein the dispensing head further comprises surfaces parallel to a dispensing axis, wherein the parallel surfaces define a passage that opens onto the dispensing orifice.

7. The container according to claim 1, wherein the dispensing orifice has a constant width in a circumferential direction.

8. The container according to claim 1, wherein the dispensing orifice has axial symmetry, preferably rotational symmetry.

9. The container according to claim 1, wherein the engaging part is hollow and provided with an internal recess, the internal recess communicating with a space formed between the engaging part and a housing of the body, the product reaching said dispensing orifice through said space.

10. The container according to claim 9, said body comprising a supply duct, the supply duct opening out next to the internal recess in the engaging part, the product to be sprayed reaching the engaging part through the supply duct.

11. The container according to claim 1, wherein at least one of the body and the engaging part has at least one relief for centering the engaging part in a housing in the body.

12. The container according to claim 1, wherein the engaging part comprises a foot fixed to the body, the foot extending on a side of the engaging part located opposite to the dispensing orifice, the cosmetic product being supplied into a space formed between the engaging part and the body, a supply duct opening into said space at a location between two opposite axial ends of the engaging part.

13. The container according to claim 1, wherein the dispensing head further comprises two housings and two engaging parts disposed in the housings, each engaging part defining with the body, at rest, a dispensing orifice having an annular section.

14. The container according to claim 1, wherein an inlet of the product into a space defined between the engaging part and the body takes place through a supply duct having a cross-section greater than that of the dispensing orifice.

15. The container according to claim 1, wherein the dispensing orifice has, in an axial sectioning half plane, an axis, the axis converging in relation to a spraying direction.

16. The container according to claim 1, wherein the dispensing orifice has, in an axial sectioning half plane, an axis, the axis diverging in relation to a spraying direction.

17. The container according to claim 1, wherein the engaging part lies flush with a front end of the body.

18. The container according to claim 1, wherein the engaging part extends axially beyond a front end of the body.

19. The container according to claim 1, wherein the engaging part extends axially beyond a front end of the body.

20. The container according to claim 1, wherein the container is pressurized.

21. A container comprising:

at least one cosmetic product to be dispensed contained in the container;

at least one hollow valve rod or hollow pump rod; and a dispensing head, the dispensing head comprising:

a body; and an engaging part that defines with the body, at rest, a dispensing orifice having a section, wherein an opening passes axially through the engaging part, the opening being configured to allow air to flow through the engaging part to the dispensing head under an entrainment effect of a spray emitted through the dispensing orifice.

wherein the dispensing head configured to be pressed to activate the hollow valve rod or hollow pump rod to convey the at least one cosmetic product through the dispensing orifice of the dispensing head from the container.

22. The container according to claim 21, wherein the container is pressurized.

* * * * *